US005270612A

United States Patent [19]

Fogelson

[11] Patent Number: 5,270,612

[45] Date of Patent: Dec. 14, 1993

[54] INLAID SUPPORT FOR AN FTM MASK SUPPORT STRUCTURE

[75] Inventor: Mark Fogelson, Wilmette, Ill.

[73] Assignee: Zenith Electronics Corporation, Glenview, Ill.

[21] Appl. No.: 839,833

[22] Filed: Feb. 21, 1992

[51] Int. Cl.[5] ..... H01J 29/07

[52] U.S. Cl. ..... 313/477 R; 313/407; 313/408; 313/482; 220/2.1 A

[58] Field of Search ..... 313/402, 408, 407, 456, 313/477 R, 482, 244, 285, 406; 220/2.3 A, 2.1 A

[56] References Cited

U.S. PATENT DOCUMENTS

| | | | |
|---|---|---|---|
| 2,949,702 | 8/1960 | Blanding et al. | 65/41 |
| 3,417,274 | 12/1968 | Bennett et al. | 313/406 X |
| 3,973,964 | 8/1976 | Lange | 29/25.17 |
| 4,695,761 | 9/1987 | Fendley | 313/407 |
| 4,716,334 | 12/1987 | Fendley et al. | 313/407 |
| 4,725,756 | 2/1988 | Kaplan | 313/407 |
| 4,728,854 | 3/1988 | Fendley | 313/407 |
| 4,739,217 | 4/1988 | Fendley et al. | 313/407 |
| 4,783,614 | 11/1988 | Kraner | 313/402 X |
| 4,828,523 | 5/1989 | Fendley et al. | 445/30 |
| 4,891,546 | 1/1990 | Dougherty et al. | 313/407 |
| 4,900,977 | 2/1990 | Lopata et al. | 313/407 |
| 5,152,707 | 10/1992 | Dougherty et al. | 445/52 |
| 5,162,694 | 11/1992 | Capek et al. | 313/407 |

*Primary Examiner*—Donald J. Yusko
*Assistant Examiner*—Ashok Patel

[57] ABSTRACT

A faceplate for a tension mask CRT has a plurality of metallic inlays embedded in the glass of an inner surface of the faceplate. The inlays have a surface substantially coplanar with the faceplate inner surface for receiving and securing thereto a tension mask frame.

6 Claims, 3 Drawing Sheets

INLAID SUPPORT FOR AN FTM MASK SUPPORT STRUCTURE

CROSS-REFERENCE TO RELATED APPLICATIONS

This application is related to but in no way dependent upon copending application Ser. No. 07/654,843 filed Feb. 13, 1991, of common ownership herewith.

BACKGROUND OF THE INVENTION

1. Field of the Invention

This invention relates to color cathode ray picture tubes, and is addressed specifically to an improved system for mounting the support frame for a tension mask in a flat tension mask (FTM) cathode ray tube (CRT).

A tension foil shadow mask is a part of the CRT front assembly, and is located opposite the viewing side of the faceplate in close adjacency to the faceplate. A shadow mask for an FTM CRT comprises an apertured metallic foil which may, by way of example, be about 0.001 inch thick, or less. As is well known in the art, a shadow mask acts as a color-selection electrode, or "parallax barrier," that ensures that each of the three beams generated by the electron gun located in the neck of the tube lands only on assigned phosphor targets.

The mask is welded to and supported in high tension at a predetermined distance from the inner surface of the face panel by a rectangular mask frame that extends from and is secured to the faceplate. The purpose of the frame, which encloses the centrally located phosphor screen, is to support the mask a predetermined, exact distance from the screen, a dimension known as the Q-distance. A mask frame may comprise a one-piece unitary structure, or it may be made up of four discrete support segments in facing relationship and joined at the corners. Alternatively, the frame may consist of a plurality of unjoined, discrete segments as The sides of the frame are referred to individually as "rails." The apertured foil that comprises the mask is stretched over the rails and welded to the top of a mask-receiving surface on the mask frame.

The mask frame must be of high strength to withstand the high tension of the mask after it is stretched over the frame and welded to the frame. A loose frame or an inward tilt of the frame under the tension forces of the mask can cause misregistration of the mask apertures with the phosphor deposits on the screen, resulting in color impurities in the picture display. Also, the mask frame must be affixed securely to the glass of the faceplate to derive strength therefrom, thus allowing for a smaller and lighter frame which need not independently support the tensioned shadow mask.

A mask frame can be secured to a faceplate by a cement such as a devitrifying solder glass, as disclosed in U.S. Pat. No. 4,695,761 to Fendley, commonly owned herewith. In its devitrified form, the solder glass is in a crystalline state which is irreversible, and it will remain a solid adhesive during ensuing, high-temperature production operations. While effective as a means of attachment of a mask frame to the glass of a faceplate, the solder glass and the frame are subject to heat expansion and shrinkage during the high-temperature devitrifying process which affects its flatness and the resulting accuracy of Q-height. Also, solder glass has a high flow rate during heating and forms a bead of glass which reduces the usable screen area. Further, it is difficult to handle and apply, and the devitrifying process entails an additional production step with concomitant high temperature.

FTM frames are usually made of a metal alloy that is compatible with the inner environment of the cathode ray tube The alloy is selected to have a coefficient of thermal expansion (CTE) compatible with that of the glass of the faceplate. An example of an all-metal frame is disclosed the afore-cited '761 patent. Alternatively, the mask frame may be made up of a ceramic base which is secured to the faceplate, and topped with metal cap to which the mask is attached by means such as welding. A mask frame of this type is described and claimed in U.S. Pat. No. 4,891,546, also commonly owned.

As is known, the screening of faceplates is currently accomplished by the mating of a shadow mask and faceplate, and photoexposing a series of chemically sensitized coatings on the screening area that is located on the inner surface of the faceplate. The resulting screen consists of a black deposit that surrounds discrete phosphor deposits. This process is described in U.S. Pat. No. 3,973,964 to Lange, of common ownership. While this manufacturing process can produce excellent screens, it is expensive and time-consuming because of the number of steps required, and the need for elaborate production machinery operated by highly skilled personnel.

Direct contact printing of screen elements to CRT faceplates, in which the matrix and the phosphor deposits are accurately formed on the screening area by some form of printing, is a viable alternative for an interchangeable mask system; that is, a system in which masks and screens do not have to be mated, and in which any mask can be used with any screen. A process of this type is set forth in referent copending application Ser. No. 07/654,843 entitled "Method and Apparatus for Direct Contact Printing Screens on CRT Faceplates."

In the direct contact printing of flat tension mask tubes, the process of printing on the faceplate can be hindered by the presence of the mask frame, which heretofore had to be permanently installed on the inner surface of the faceplate prior to the printing. An installed frame acts as a barrier to the printing roller or other screen printing means as it must be designed so it will not be impeded by the mask frame and the bead of solder glass that surrounds it, an expedient which unduly complicates the printing process. Ideally, the screen is printed on the screening surface of a flat faceplate before the mask frame is installed.

An "open" frame; that is, one that is not unitary, but has openings at the corners, for example, complicates the application of screening slurries by the spin-coating process. In this process, the screen is rotated while a grille or phosphor slurry is poured on the center of the screen. A uniform application of the phosphor results from the spinning. The presence of an open frame mask is an obvious impediment because phosphor particles are entrapped in the frame, and the coatings resulting from the spin-off of the slurries is uneven.

2. Related Art

In U.S. Pat. No. 4,716,334 to Fendley, there is disclosed a mask frame in which the metal of the frame is caused to physically penetrate the glass of the faceplate, obviating the need for attachment by a cement such as solder glass. A frame such as this impedes the printing of a screen because it is an integral and unremovable part of the faceplate prior to the screening.

Lopata et al in U.S. Pat. No. 4,900,977, discloses a reference and support system for a flat CRT tension mask. A mask frame is shrink-fitted onto a peripheral surface of the face panel surrounding the target area, or screen. The upper edge of the frame is finished so as to provide the desired Q-spacing between the screen area and the top of the support frame where the mask is to be attached. A temporary fixture is described which is used in applying various phosphors to a target area, and in positioning a tensed shadow mask on the support frame. The temporary fixture mechanically registers with the support frame. An embodiment is also disclosed in which the base of the mask frame is shown as being emdedded in the faceplate at its periphery.

The embedment of metal in glass is the subject of U.S. Pat. Nos. 2,949,702 to Blanding et al and 3,417,274 to Bennett et al.

3. Other Related Art

U.S. Pat. No. 4,725,756 to Kaplan, of common ownership herewith.

OBJECTS OF THE INVENTION

It is an object of the invention to:

a) provide apparatus and method that facilitates the adoption and use of the interchangeable mask system.

b) provide means for facilitating the direct contact printing of phosphor screens on faceplates.

c) provide means for the installation of the mask supporting frame after the faceplate has been screened.

d) provide means for the attachment of a mask frame to a faceplate without the use of solder glass cement for the attachment.

BRIEF DESCRIPTION OF THE DRAWINGS

The features of the present invention believed to be novel are set forth with particularity in the appended claims. The invention, together with further objects and advantages thereof, may best be understood by reference to the following description taken in conjunction with the accompanying drawings (not to scale) the several figures of which like reference numerals identify like elements, and in which:

DESCRIPTION OF THE PREFERRED EMBODIMENT

Figure 1:
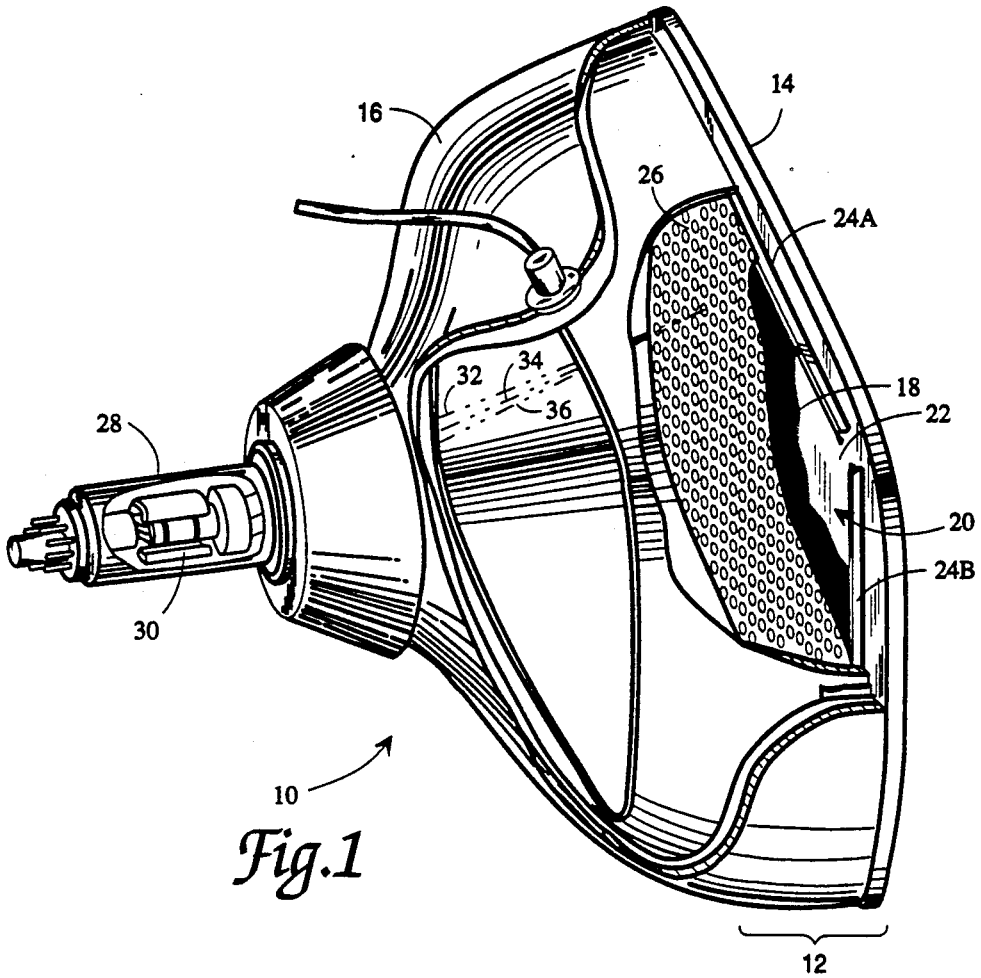
FIG. 1 is a side view in perspective of a tension mask color cathode ray tube having improved means for mounting and and supporting a tension mask frame with cutaway sections that reveal the location and relationship of the major components of the tube.
Figure 2:
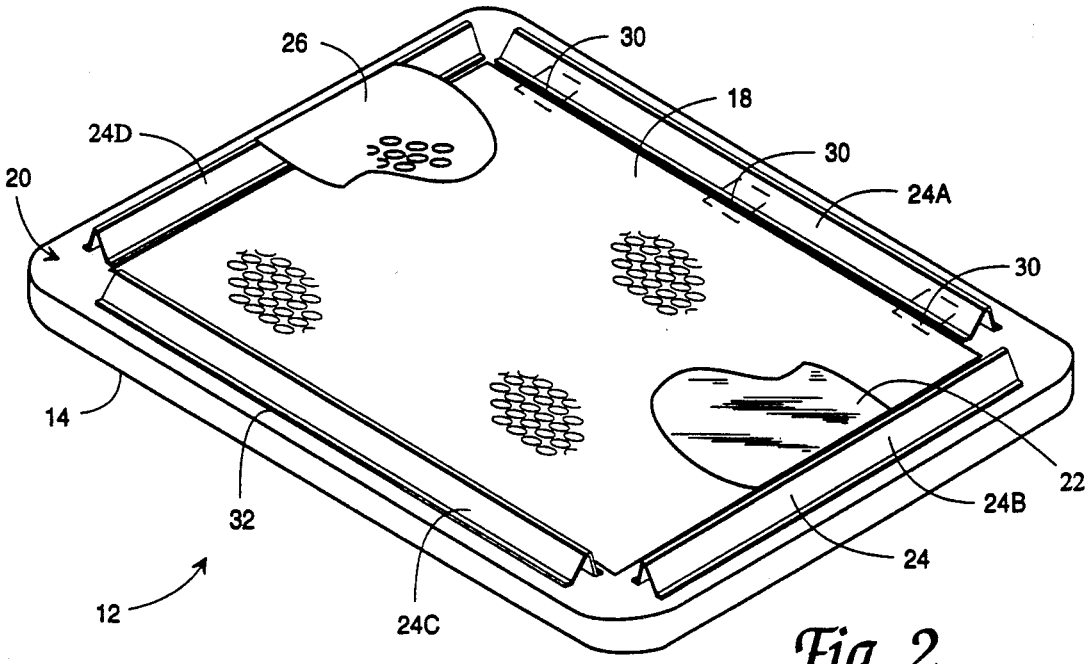
FIG. 2 is a perspective view of the front assembly of the tube depicted in FIG. 1, with the shadow mask cut away to provide visual access to the means of attaching the rails of a shadow mask support structure to the glass of the faceplate according to the invention.

With reference to FIGS. 1 and 2, an FTM color cathode ray tube 10 has a front assembly 12 that includes a faceplate 14 sealed to a funnel 16. A centrally disposed rectangular screen 18 is deposited on the inner surface 20 of faceplate 14. A film of aluminum 22 covers the screen 18. The rectangular screen 18 is enclosed by a mask frame that consists of four discrete rails 24A, 24B, 24C and 24D which extend from the faceplate 14 for receiving and attaching a metal foil shadow mask 26 in tension. The neck 28 that extends from funnel 16 encloses an in-line electron gun 30 that projects three discrete electron beams 32, 34 and 36 that excite the phosphors deposited on screen 18 that emit red, green and blue light to form a color picture visible through the front surface of faceplate 14.

FIG. 2 is a depiction of front assembly 12 indicating in greater detail the inner surface 20 of faceplate 14, with the mask 26 cut away to expose details of the front assembly 12. In this embodiment of a front assembly, the mask frame is shown as comprising four discrete rails 24A, 24B, 24C and 24D, with gaps between the rails at each of the four corners of faceplate 14, as depicted. The mask frame could as well comprise a single unit joined at the corners, or the rails could comprise a plurality of segments.

Figure 3:
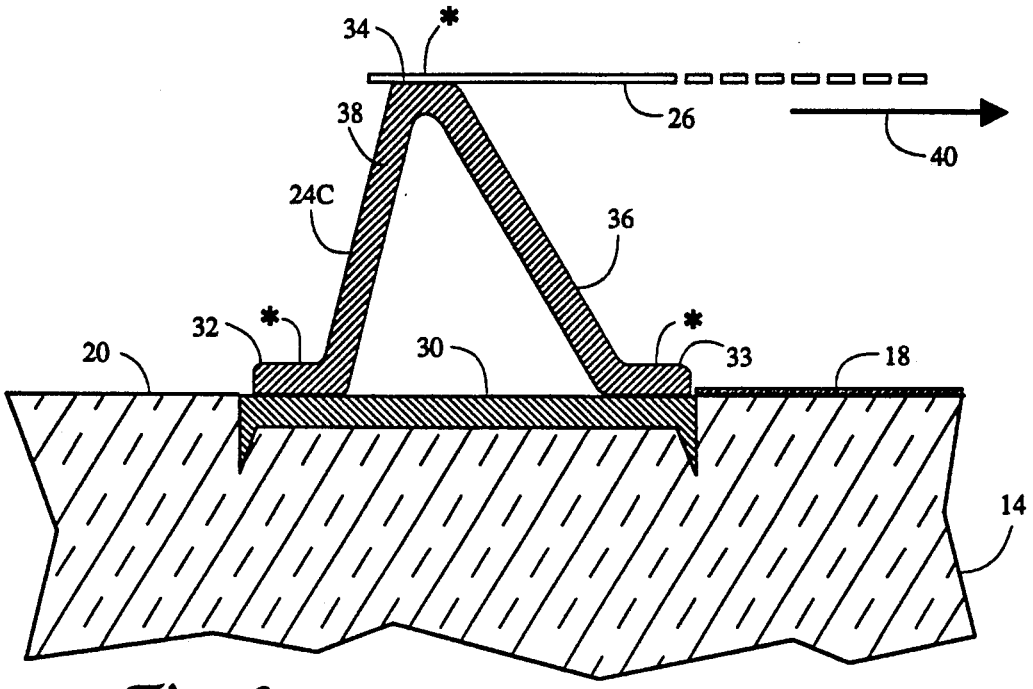
FIG. 3 is a cross-sectional view in elevation of a rail component of the frame of FIG. 2, indicating in detail the attachment of the rail component to an inlay embedded in the glass of the faceplate according to the invention.

Metallic inlays according to the invention embedded in the glass of the inner surface 20 of faceplate 14 provide for attaching and securing a tension foil shadow mask frame to the inner surface of the glass of the faceplate. Inlays are located beneath the rails 24A, 24B, 24C and 24D in predetermined locations, as will be described. A detail of an inlay-rail assembly is depicted in FIG. 3, using a cross-sectional view of rail 24C as an example. The inlay 30 is a metal support shown as being embedded in the inner surface 20 of the glass of the faceplate 14. The rail 24C is affixed to the inlay 30 by means of flanges extending from the rail 24C which is a part of the mask frame. Two flanges 32 and 33 are shown in this example. The securing of the flanges 32 and 33 to the inlay 30 may be by means of welding, with the approximate locations of the welds indicated by the weld symbols (*).

The metal foil shadow mask 26 is attached to the peak 34 of mask support structure 24C also by welding, as indicated by the weld symbol (*). The welding of the mask 26 to the mask support structure 24C is preferably by laser, using the process described and claimed U.S. Pat. No. 4,828,523 of common ownership herewith.

The inlay 30 is substantially coplanar, or planoparallel, with the inner surface 20 of faceplate 14. The inside leg 36 of mask support structure 24, that is, the leg nearest the screen 18, is shown as lying at a more acute angle, with reference to inner surface 20, than outside leg 38. This greater angularity, which may be in the range of sixty and seventy degrees, makes inside leg 36 a effective brace to resist the strong pull exerted by the tension of shadow mask 26, a force indicated by arrow 40. The welding of the flanges 32 and 33 to inlay 30 forms rail 24C and inlay 30 into a unified triangular structure of great strength.

Figure 4:
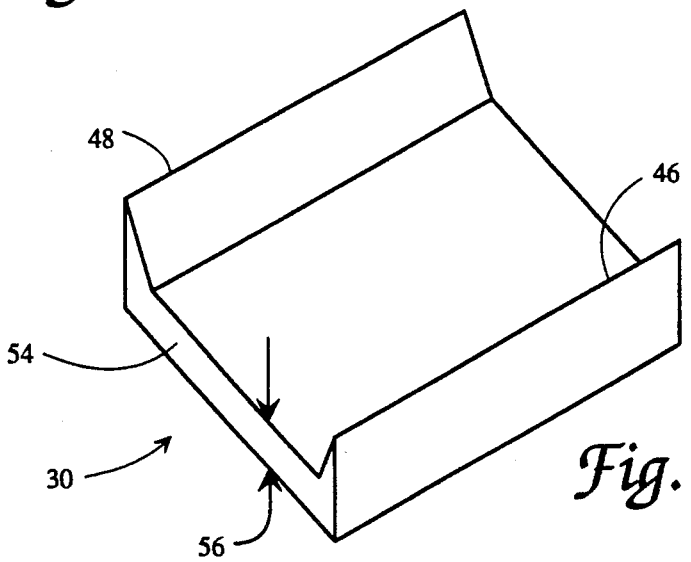
FIG. 4 detail view in perspective of the underside of the inlay depicted in FIG. 3 before its installation.

FIG. 4 is a depiction of inlay 30 prior to its installation in the glass of the inner surface 20 of the faceplate 14. In this embodiment of an inlay, two sharpened sections 46 and 48 which extend from the base 54 of the inlay 30 provide for firm penetration of the inlay 30 into the glass of the inner surface 20 of the faceplate 14. With regard to dimensions, the base 54 may, by way of example, comprise a rectangle having dimensions of 0.3125 inch by 0.50 inch, with a thickness dimension 56 of 0.125 inch. The sharpened sections 46 and 48 may extend 0.062 inch from the base 54, again by way of example.

Figure 5:
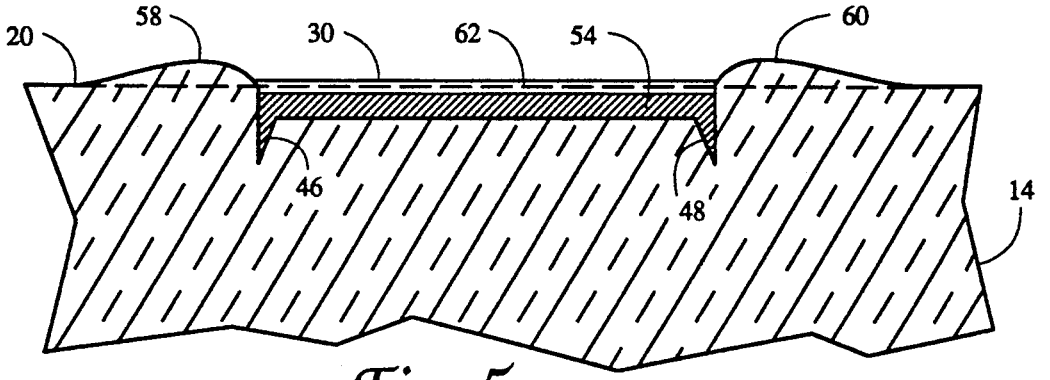
FIG. 5 is a cross-sectional view in elevation depicting the effect on the faceplate glass resulting from the hot pressing of an inlay on the glass of the faceplate.

The effect of the installation of inlay 30 upon the glass of the inner surface 20 faceplate 14 is indicated by FIG. 5. Installation of the inlay 30 as shown is by a method which is termed "hot pressing." Methods of hot pressing are known in CRT art for the attachment of self-supporting mask-mounting studs to skirted faceplates. The area of the inner surface 20 of faceplate 14 in which inlay 30 is to be installed is flame-heated to a temperature of about 1150 degrees C., and inlay 30 is in turn heated to a temperature of about 1050 degrees C. Inlay 30 is then pressed into the glass to a depth sufficient to immerse sharpened sections 46 and 48 in the glass, along with a substantial portion of the base 54 of inlay 30, as indicated. In lieu of flame-heating the inner surface, the inlays may be pressed into the heat-softened glass of a faceplate while it is being molded.

Also as indicated in FIG. 5, as a result of the hot-pressing of the inlay 30 into the inner surface 20, the heat-softened glass will bulge up in the area of insertion to form exemplary fillets 58 and 60. In an ensuing manufacturing step, the glass of faceplate 14, and the metal of inlay 30 is abraded, or ground flat, to the level indicated by dash line 62, which corresponds with the level of inner surface 20 of faceplate 14. As a result of the abrading, the fillets 58 and 60 are removed, and the surface of the inlay 30 is made substantially coplanar with the inner surface 20 of the faceplate 14. To limit the amount of abrading that may be required, the inlay should be pressed into the glass to the extent that no more than 0.0156 inch of the surface of the inlay 30 extends above the inner surface 20 of faceplate 14.

The metal from which the inlays are formed must have a CTE that is compatible with the CTE of the glass of the faceplate. Glass used in the manufacture of faceplates for color cathode ray typically has a CTE of $100\times10^7$ in./in./degree C. The preferred composition of the metal of an inlay is alloy No. 27 manufactured by Carpenter Technology, Inc., of Reading, Pa. An alloy with equivalent characteristics supplied by another manufacturer may as well be used. Carpenter alloy No. 27 has a CTE of $108\times10^7$ in./in./degree C., which is close enough in CTE to be compatible with the CTE of the faceplate glass. When the alloy is used as an inlay, and when it is cemented into the glass of the faceplate by means of solder glass, it is first oxidized to enhance adhesion to the glass.

The abrading of the inlay 30 to make it substantially coplanar with the inner surface 20 of faceplate 14 is accomplished in conjunction with the process of forming the faceplate 14 to have an inner surface 20 characterized by an undefined roughness. A subsequent lapping process is utilized to produce a predetermined roughness of the inner surface 20 that will substantially eliminate specular reflection from the inner surface 20 when the cathode ray tube is in operation. This process is fully described and claimed in U.S. Pat. No. 4,884,006 to Prazak, III, of common ownership herewith.

While the inlay must be made from a relatively expensive stainless alloy to ensure compatibility with the glass of the faceplate, the mask frame that is attached to the inlay is under no such restriction. It can be made from iron or steel, for example; the only proviso is that it must be compatible with the inner environment of the cathode ray tube. The advantage lies in the fact that a steel frame would be less expensive, stronger, and more easy to form into a mask frame configuration than a stainless steel alloy.

Figure 6:
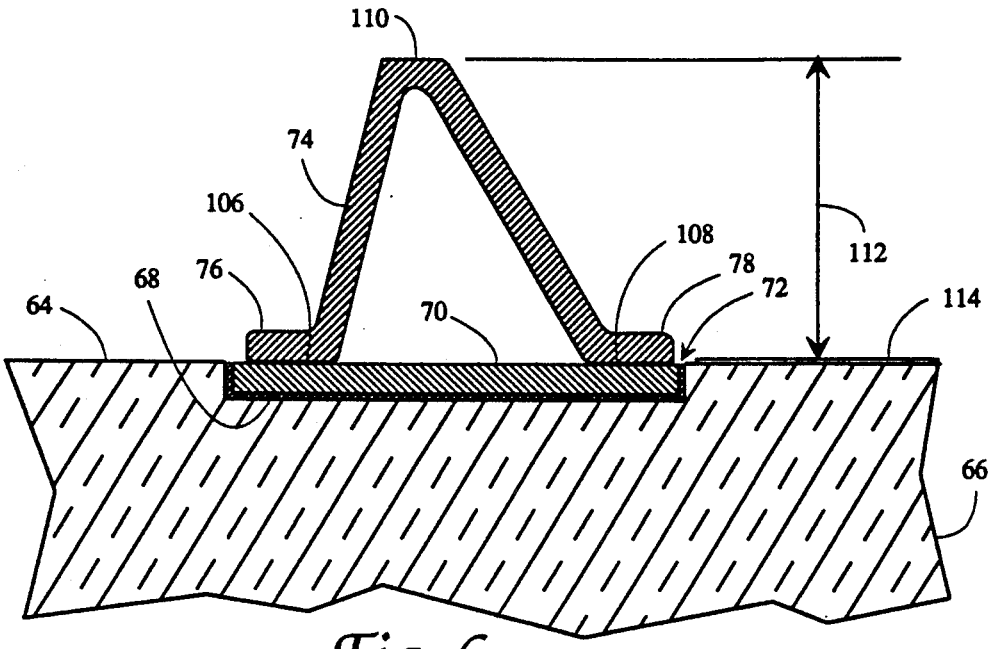
FIG. 6 is a cross-sectional view in elevation depicting an alternate to the form of inlay shown by FIG. 3.

In lieu of the hot-pressing of an inlay into faceplate glass, an inlay according to the invention may be installed by the embedding of the inlay in a groove or recess pre-ground in the glass of the inner surface of the faceplate. As indicated by FIG. 6, the inner surface 64 of a faceplate 66 has a recess 68 in which an inlay 70 is embedded. By means of the process described in the following paragraph in connection with FIG. 7, the inlay 70 is cemented into the recess 68 by means of a layer of devitrified solder glass 72 located in the space between inlay 70 and the glass of the faceplate 66, as indicated by the stipple pattern. As with the structure depicted in FIG. 3, the rail 74 is is attached to inlay 70 by means of two flanges 76 and 78 that extend from the base of rail 74, with the flanges 76 and 78 attached to the inlay 70 by welding, as described heretofore.

Figure 7:
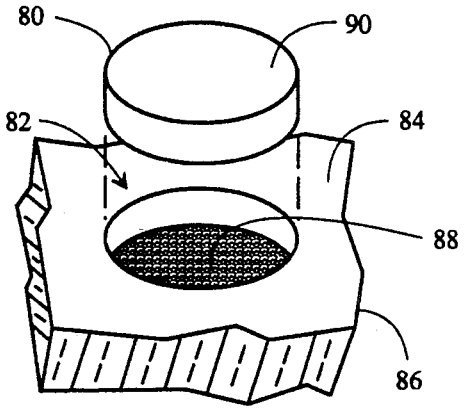
FIG. 7 is a perspective view depicting another form of an inlay according to the invention; figure a cross-sectional view in elevation of the inlay depicted in FIG. 7.

By way of example, a recess for receiving an inlay may comprise a round recess for receiving a round inlay. This embodiment is depicted in FIG. 7 in which a round inlay 80 is shown in readiness for embedding in a round recess 82 in the inner surface 84 of a faceplate 86. The round recess 82 may be readily formed in the glass of the inner surface 84 of faceplate 86 by a vertical spindle grinding machine using a diamond boring tool in conjunction with a cutting fluid. A quantity of devitrifying solder glass 88, indicated by the stipple pattern, is deposited in a semi-liquid, unfired state in round recess 82. The outside diameter of the round inlay 80 is smaller by about 0.020 inch than the inside diameter of the round recess 82; as a result, the solder glass 88 will flow into the space between the walls of the round inlay 80 and the walls of the round recess 82. Any excess solder glass 88 that flows out onto the inner surface 84 of faceplate 86 is ground off during an operation in which the surface 90 of round inlay 80 is formed to be substantially coplanar with inner surface 84, a procedure that has been described in connection with FIG. 5. Care must be taken during the installation because devitrified solder glass is brittle an any undue pressure on the inlay will resulting in cracking of the solder glass.

Figure 7A:
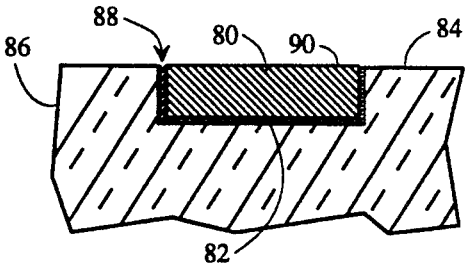

The appearance of the inlay 80 when embedded in devitrified solder glass 88 deposited in round recess 82 of the inner surface 84 of the faceplate 86, is indicated in the cross-sectional view, FIG. 7A. As indicated, the surface 90 has been formed to be substantially coplanar with the inner surface 84 of faceplate 86.

The solder glass 88 may comprise a product supplied by Corning Glass Works of Corning, New York, under the designation Glass 7595. A devitrifying solder glass is a viscous glass that crystallizes and hardens when heated to a predetermined temperature, such as a temperature of 460 degrees C., and which does not remelt upon a reheating to that temperature. As a result, the solder glass forms a permanent cement unaffected by the high temperatures that are required in the final assembly of a cathode ray tube.

Figure 8:
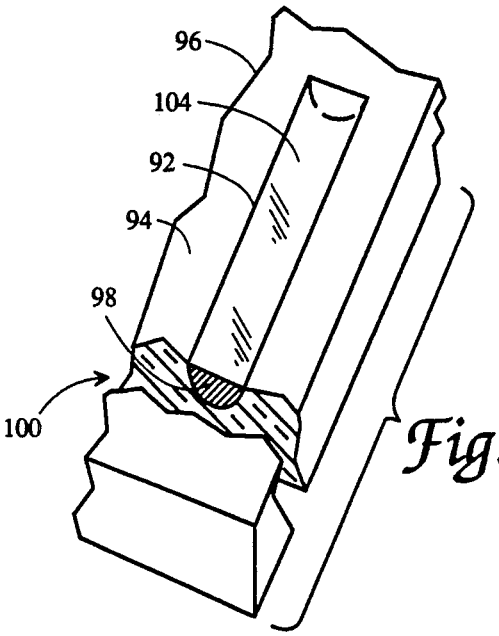
FIG. 8 is a perspective view of yet another form of inlay according to the invention.
Figure 8A:
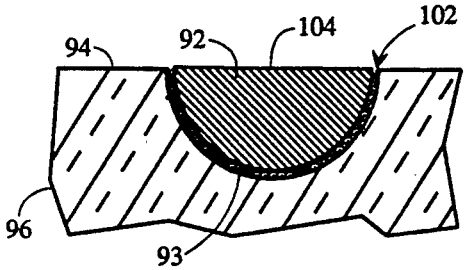
FIG. 8A is a cross-sectional view in elevation of the inlay depicted in FIG. 8.

Also by way of example, an inlay according to the invention can take the form depicted in FIGS. 8 and 8A in which a half-round inlay 92 is shown as being embedded in a half-round round recess 93 formed in the inner surface 94 of a faceplate 96. The end 98 of inlay 92 is depicted in the broken-away section 100 of faceplate 96, and is shown as being of half-round configuration. Inlay 92 can be formed from a half-round metal stock such Carpenter Alloy No. 27, and embedded in a layer of devitrified solder glass 102 indicated by the stipple pattern, as has been described in connection with FIGS. 6, 7 and 8. As before, the surface 104 inlay 92 is ground so as to be substantially coplanar with inner surface 94 of faceplate 96. The half-round recess 93 in which inlay 92 is embedded can be formed by grinding the glass of the inner surface 94 by means of a groove-shaped wheel conforming to the half-round configuration of the half-round inlay 92.

With regard to the placement of the inlays according to the invention in conjunction with a faceplate, an inlay such as inlay 92 depicted in FIGS. 8 and 8A may be located beneath each of the rails rail 24A, 24B, 24C and 24D, shown by FIG. 2, and lie along their entire length (not indicated). Alternately, a plurality of rectangular inlays 30 such as the inlay 30 shown by FIGS. 3–5, can be located at predetermined intervals along a rail, such as a plurality three inlays 30 indicated as lying beneath rail 24A in in FIG. 2. A similar pattern of inlays, can be located beneath the other rails, rails 24B, 24C and 24D.

In addition to the triangular mask support configurations depicted in FIGS. 3 and 6, a mask support may comprise an undulating support structure as disclosed in U.S. Pat. No. 4,728,854, pan A-shaped structure as disclosed in U.S. Patent No. 4,739,217, or an L-shaped structure as disclosed in U.S. Pat. No. 4,783,614. These patents, which are all of common ownership herewith, are incorporated herein by reference.

To facilitate the installation of inlays, recesses may be formed in the glass of the inner surface of the the faceplate during the faceplate molding process. By installing the recesses during the molding process, forming of the recesses by grinding or grooving is made unnecessary. Further, the presence of molded-in recesses facilitates the hot-pressing of inlays into the glass. Also, the insertion of an inlay by hot-pressing into a molded-in recess minimizes the amount of glass that is displaced during hot pressing, with a consequent reduction of stress on the glass.

The apparatus and method according to the invention provide many benefits and advantages that can facilitate the manufacture of FTM cathode ray tubes. A primary advantage is that a mask frame, whether in unitary form or in the form of a number of discrete rails, can be installed after the multi-color phosphor screen has been deposited on the screening surface. This makes possible the deposit of phosphors on the screening surface unimpeded by the presence of a mask frame, a feature that facilitates the printing of screens by the method described in the afore-mentioned copending application Ser. No. 654,843 entitled "Method and Apparatus for Direct Contact Printing Screens on CRT Faceplates."

It is noted that the absence of a mask support structure also facilitates the screening of faceplates by the process in which a faceplate and a shadow mask are permanently mated, a process described in the aforementioned '964 to Lange, of common ownership. Such screening may be accomplished by the aforedescribed spin-coating process, in which the presence of a mask frame can act as impediment to the screening process.

Another advantage lies in the fact that the mask frame can be attached to the inner surface of the faceplate without the use of a cement such as solder glass, which is otherwise needed for direct attachment of the material of the frame to the glass. The absence of the bead of solder glass provides more area for the screen, which can be deposited so close to the mask frame as to directly contact it.

A disadvantage inherent in installing the mask frame before screening is that dried particles of the screening slurries can be captivated by the support. Such particles can emerge during the operation of the tube and cause electrical arcing and poisoning of the cathodes of the electron gun. This problem is addressed in commonly owned U.S. Pat. No. 4,891,545, and it resolved by filling the voids in a mask support with solder glass, which effectively bars the entrance of screening fluids. The problem is completely avoided by installing the mask support after the screening operation has been completed.

Lastly, the mask frame can be constructed so that upon its attachment to the inlays according to the invention, its top, mask-receiving surface will be at the exact, desired Q-height. FIG. 6 depicts a rail 74 attached to an inlay 70 by means of two flanges 76 and 78 that extend from the base of the rail 74. To enable the rail 74 to provide the proper Q-height upon its installation, the bottom surfaces 106 and 108 of respective flanges 76 and 78 are formed to be flat and coplanar, preferably by grinding. The top surface 110 of rail 74, which receives a foil mask in tension (as indicated by the position of mask 26 in FIG. 3), is then ground or otherwise abraded to a depth that will provide the proper Q-height 112 between the mask and the screen 114 when the mask is installed.

When solder glass is used for cementing a mask frame to the inner surface, as in the prior art, it is not feasible to install rails that are already ground to preferred Q-height as the intervening layer of solder glass between the base of the rail and the inner surface of the faceplate will shrink unpredictably, and the desired Q-height will not be achieved.

While a particular embodiment of the invention has bee shown and described, it will be readily apparent to those skilled in the art that changes and modifications may be made in the inventive means and method without departing from the invention in its broader aspects, and therefore, the aim of the appended claims is to cover all such changes and modifications as fall within the true spirit and scope of the invention.

I claim:

1. A faceplate for a tension mask CRT having a plurality of metallic inlays embedded in the glass of an inner surface of the faceplate, the inlays having a surface substantially coplanar with the faceplate inner surface for receiving and securing thereto a tension mask frame.

2. The faceplate according to claim 1 including a mask frame having flanges extending therefrom and attached to the inlays.

3. The faceplate according to claim 2 wherein the flanges are attached to the inlays by welds.

4. The faceplate according to claim 1 wherein the inlays are hot-pressed into the inner surface of the faceplate.

5. The faceplate according to claim 1 wherein the inlays are cemented in recesses formed in the inner surface.

6. The faceplate according to claim 5 wherein the recesses comprise grooves formed in the inner surface.

* * * * *